US011330878B2

(12) United States Patent
Waswill

(10) Patent No.: US 11,330,878 B2
(45) Date of Patent: May 17, 2022

(54) SPORTS BAG

(71) Applicant: John J. Waswill, Marlborough, MA (US)

(72) Inventor: John J. Waswill, Marlborough, MA (US)

( * ) Notice: Subject to any disclaimer, the term of this patent is extended or adjusted under 35 U.S.C. 154(b) by 0 days.

(21) Appl. No.: 17/022,244

(22) Filed: Sep. 16, 2020

(65) Prior Publication Data

US 2022/0079313 A1 Mar. 17, 2022

(51) Int. Cl.

| | |
|---|---|
| ***A45C 7/00*** | (2006.01) |
| ***A45C 3/00*** | (2006.01) |
| ***A45C 13/10*** | (2006.01) |
| ***A45C 13/26*** | (2006.01) |

(52) U.S. Cl.

CPC ..... *A45C 7/0086* (2013.01); *A45C 3/001* (2013.01); *A45C 3/004* (2013.01); *A45C 7/0095* (2013.01); *A45C 13/103* (2013.01); *A45C 13/26* (2013.01); *A45C 2003/002* (2013.01); *A45C 2003/007* (2013.01)

(58) Field of Classification Search

CPC ..... A45C 7/0086; A45C 3/001; A45C 3/004; A45C 7/0095; A45C 13/103; A45C 13/26; A45C 2003/002; A45C 2003/007

USPC ..... 383/37–40

See application file for complete search history.

(56) References Cited

U.S. PATENT DOCUMENTS

| | | | | | |
|---|---|---|---|---|---|
| 3,128,854 | A * | 4/1964 | Specht | A45C 3/00 | 206/289 |
| 4,693,344 | A * | 9/1987 | Shuler | A45C 3/00 | 190/107 |
| 4,753,329 | A * | 6/1988 | Choy | A45C 7/0095 | 190/107 |
| 5,375,929 | A * | 12/1994 | Bergmoser | B65D 29/04 | 383/117 |
| 5,427,453 | A * | 6/1995 | Cloessner | A45C 3/00 | 190/109 |
| 5,490,619 | A * | 2/1996 | Boyar | A45C 7/0077 | 150/103 |
| D386,613 | S * | 11/1997 | Terzian | D3/287 | |
| 6,039,474 | A * | 3/2000 | DeChant | A45C 3/00 | 190/109 |
| 6,619,447 | B1 * | 9/2003 | Garcia, III | A45C 7/0086 | 150/111 |
| D530,915 | S * | 10/2006 | Sijmons | D3/289 | |
| 8,413,776 | B1 * | 4/2013 | Huff | A45C 15/00 | 190/109 |
| 8,695,796 | B2 * | 4/2014 | Byers | A45C 3/001 | 206/315.9 |
| 9,854,889 | B2 * | 1/2018 | Amago | A45C 13/02 | |
| 2003/0223651 | A1 * | 12/2003 | Weleczki | A63B 55/40 | 383/4 |

(Continued)

*Primary Examiner* — Peter N Helvey
(74) *Attorney, Agent, or Firm* — Lorusso & Associates

(57) ABSTRACT

A segmented duffle bag with a single continuous strap. A cylindrical duffle bag with two segments secured together with diametrically opposed longitudinal zippers. A multi-segmented duffle bag with two semi-cylindrical segments secured together with longitudinal zippers and each semi-cylindrical segment having quarter sections secured together with an annular zipper. The single continuous strap functions as a hand grip or a shoulder strap and maintains the connectivity of the duffle bag segments even when separated.

11 Claims, 5 Drawing Sheets

(56) References Cited

U.S. PATENT DOCUMENTS

| | | | | |
|---|---|---|---|---|
| 2004/0008907 | A1* | 1/2004 | Bartlett | A01K 97/06<br>383/7 |
| 2006/0239593 | A1* | 10/2006 | Fidrych | A45C 13/02<br>383/40 |
| 2007/0017948 | A1* | 1/2007 | Smithson | A45C 3/00<br>224/663 |

* cited by examiner

SPORTS BAG

CROSS-REFERENCE TO RELATED APPLICATIONS

None.

FIELD OF THE DISCLOSURE

The disclosure relates to bags for holding clean and soiled garments and sports equipment. More particularly, this disclosure concerns compartmentalized, foldable bags with single straps that permit the bag to be opened fully without removal of the strap.

BACKGROUND OF THE DISCLOSURE

Bags for holding clothing and equipment, sports bags, in particular, often include compartments to hold soiled, sweaty clothing that separate the clothing from other compartments in the bag. The compartments may be constructed with solid compartment walls or may have one or more mesh walls to permit airflow through the compartment. As is commonly known, mesh walls are particularly useful for airing out compartments holding sweaty clothing. These bags often have two straps secured to opposing sides of the bag. When the straps are grasped together, the orientation of the bag straps provides a means for balancing the bag while being carried.

Another type of bag I created is a modification of the conventional rectangular-shaped sports bag. As shown in FIGS. 1 and 2, my sports bag designated generally as 1 has a cylindrical shape with two separable compartments 2 that are combined or connected along the longitudinal axis of the bag with a pair of long zippers 3 that begin at a first end of the bag and end at a second end of the bag so the two sections can be completely separated as the bag ends are not connected. Two straps 4, each dedicated to a single bag half, are secured to a specific half via stitching, rivet and the like connection means, and provide a way to carry the individual sections. Each strap may have a shoulder pad or carry grip 5 to provide a cushioning effect when placed on a shoulder or when grasped with a hand. To carry the bag when fully assembled, the two straps may be connected together with something like a Velcro® releasable grip handle and grasped together as is commonly known.

Although my initial bag design provides some very usable and convenient features, the use of two straps proved to be limiting. My initial design results in the two bag sections or halves being completed separated when unzipped. Once unzipped, the location of the dedicated bag straps, which are positioned to balance the bag when fully assembled, become somewhat unwieldly and unbalanced. Moreover, because the bags are like conventional duffle bags, they can be long and cumbersome in longer sizes, especially if the two halves are separated.

What I have invented is a combination dual chamber bag with a single continuous strap that can slide through a series of D-rings to permit the bag to be carried, opened freely and disassembled without interference from the strap. By further dividing each cylindrical half into quarters, my new sports bag can be wrapped around the waist like a fanny pack with the strap functioning as a shoulder harness by placing the strap over one or both shoulders. My new bag also has an optional belt feature that makes it possible to secure the free ends of the bag at the front of an individual so the bag is stationary about the waist. This takes pressure off the shoulders when carrying the bag and makes it possible to carry heavier loads.

What is needed is a segmented duffle bag with one or more free-flowing straps to provide variability in the way weight is distributed in the bag and how that weight is balanced by the straps when being carried in different configurations and manners. These and other objects of the disclosure will become apparent from a reading of the following summary and detailed description of the disclosure as well as a review of the appended drawings.

SUMMARY OF THE DISCLOSURE

In one aspect of the disclosure, a separable dual chamber bag is combined with a single continuous strap that can slide through a series of D-ring assemblies to permit the bag to be carried, separated and opened freely without interference from the strap. The continuous strap is made sufficiently long to permit the strap to extend out when the bag is fully separated and opened.

In another aspect of the disclosure, a segmented and partially separable four-chamber bag is combined with a single continuous strap. The bag is divided along its longitudinal axis into two semi-cylindrical halves. Each half has at least one zipper oriented orthogonal to the longitudinal axis to permit each half to be segmented into quarter or more than quarter sections. The quarter sections are attached at flexion points that permits the quarter sections to be rotated about the flexion points and wrapped around an individual's waist similar in fashion to a fanny pack. The single, continuous strap has sufficient length to function as a single or dual shoulder strap.

In a still further embodiment, my new bag also has a belt feature that makes it possible to secure the free ends of the bag at the front of an individual so the bag remains secured to, and stationary about, the waist. This takes pressure off the shoulders when carrying the bag and makes it possible to carry heavier loads. The duffle bag with quarter sections includes a releasably engageable waist belt to secure the duffle bag around the individual. The waist belt has translational sections to permit the belt to be cinched against the individual. A quick release belt assembly permits and facilitates locking and unlocking the belt.

In another aspect of the disclosure, a segmented dual chamber bag is combined with a single continuous strap that can slide through a series of D-ring assemblies to permit the bag to be carried and opened into two semi-cylindrical segments, each of which can be opened freely without interference from the strap. The continuous strap is made sufficiently long to permit the strap to extend out when the bag is fully separated and opened. These and other aspects of the disclosure will become apparent from a review of the appended drawings and a reading of the following detailed description of the disclosure.

DETAILED DESCRIPTION OF THE DISCLOSURE

Figure 1:
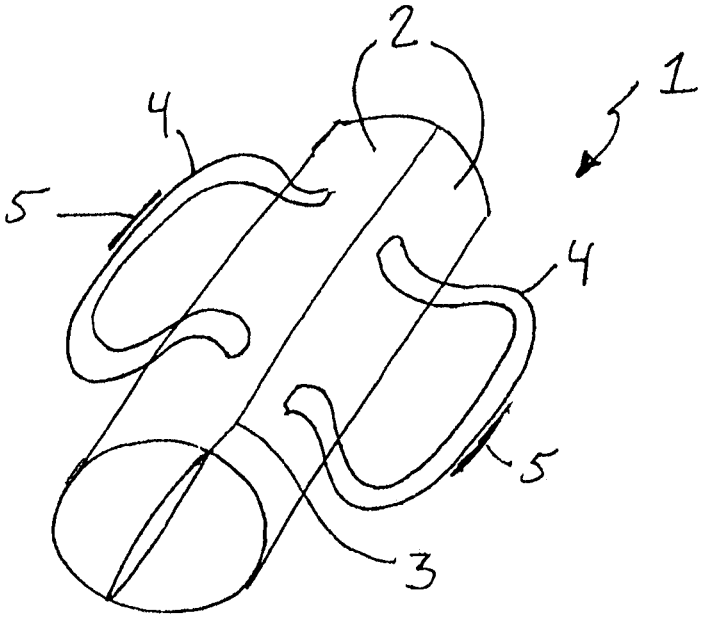
FIG. 1 is a top perspective view of a relevant art duffle bag.
Figure 2:
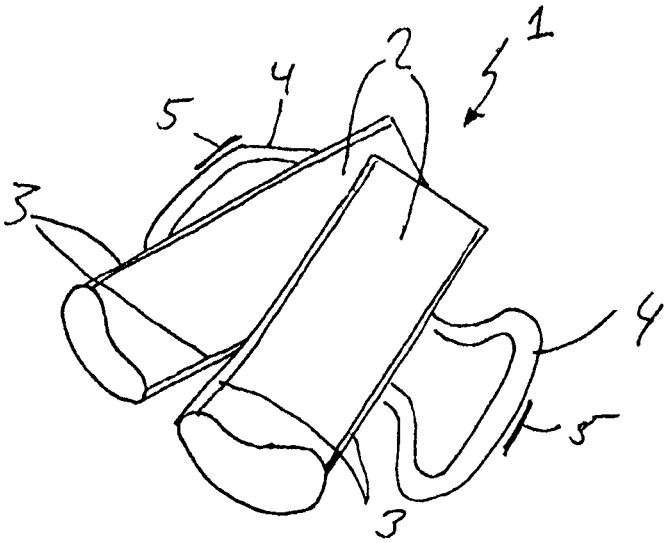
FIG. 2 is an exploded, top perspective view of the duffle bag shown in FIG. 1 with two bag halves separated.
Figure 3:
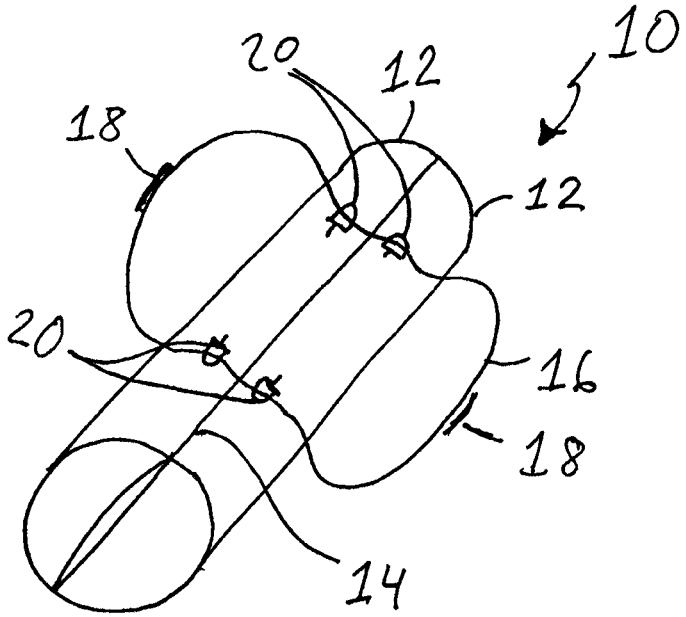
FIG. 3 is a top perspective view of a single-strap, cylindrical duffle bag according to one embodiment of the disclosure.
Figure 4:
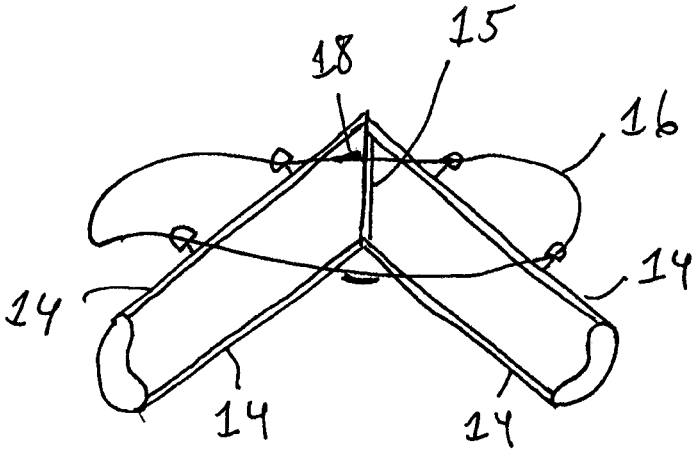
FIG. 4 is an exploded, top perspective view of the cylindrical duffle bag shown in FIG. 3 with two bag halves disassembled.

Referring to FIGS. 3 and 4, in one aspect of the disclosure, a duffle bag designated generally at 10 includes two semi-cylindrical sections 12 secured together with zippers 14 placed along the longitudinal edges of sections 12. Alternatively, sections 12 may be releasably secured together with Velcro® or Velcro-like hook and loop releasable connections. Each section 12 can have single compartment or may include multiple compartments separated illustratively by dividers, pockets, solid flexible walls and mesh walls. Individual closure means such as additional zippers, snap buttons and Velcro® hook and loop releasable connections may be used to further separate multiple compartments. The materials used to construct the duffle bag may be canvas, mylar, nylon, and like materials. It should be understood any material or fabric can be used to construct the duffle bag.

Figure 11:
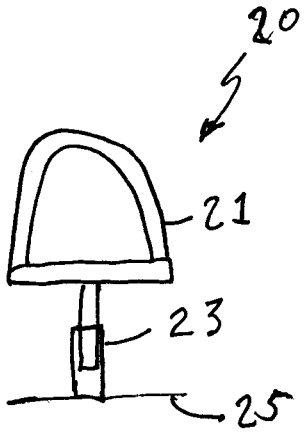
FIG. 11 is a side view in elevation of a D-ring according to one embodiment of the disclosure.

Secured to each section 12 are at least two D-ring assemblies 20. Each D-ring assembly 20 may be fixed directly to section 12 or may have a D-ring 21 secured to a post 23, which, in turn, is secured to an anchor plate 25, as shown in FIG. 11, with the plate secured to section 12. D-ring 21 can rotate about post 23 and be spring actuated to pull away from the post without disengagement. A single continuous strap 16 is passed through the plurality of D-ring assemblies 20. The strap length is set to permit the sections 12 duffle bag 20 to be fully disassembled without interfering with the full separation and axis to the one or more compartments in sections 12 as shown in FIG. 4. One or more shoulder pads/hand grips 18 formed with slots for receiving and interweaving with strap 16 permit shoulder pad/hand grip 18 to be positioned at different points along strap 16 to provide customization for differently sized individuals.

As shown in FIG. 4, a back end of duffle bag 10 includes a section connection zipper 15 to releasably secure sections 12 together at a single end so the sections may be separated sufficiently to empty or fill the sections. Zipper 15 permits the sections 12 to be fully disassembled or can function as a hinge to permit the sections to be spread apart, but maintained connected. Alternatively, zipper 15 may be replaced with a section of cloth or other flexible material such as neoprene to permanently secure the section ends together and still permit the sections to be partially separated or rotated apart for loading and/or unloading.

Figure 5:
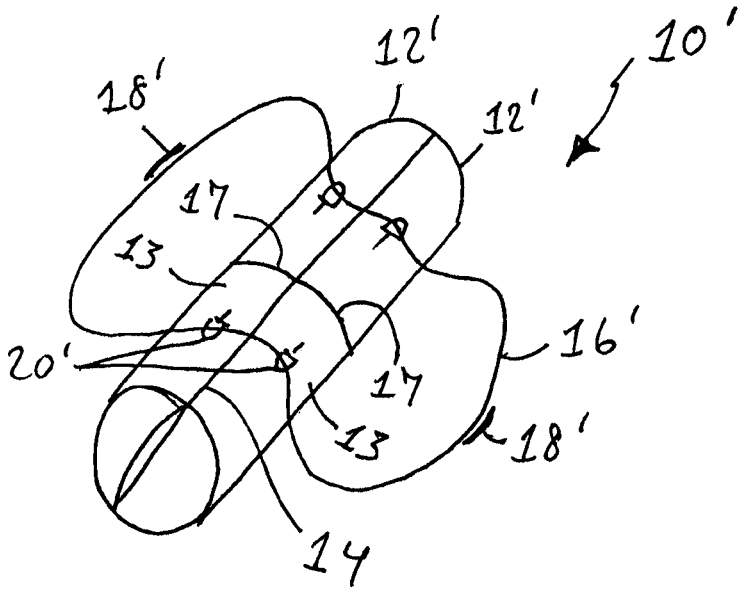
FIG. 5 is a top perspective view in elevation of a single strap, cylindrical duffle bag with quarter sections according to another embodiment of the disclosure.
Figure 6:
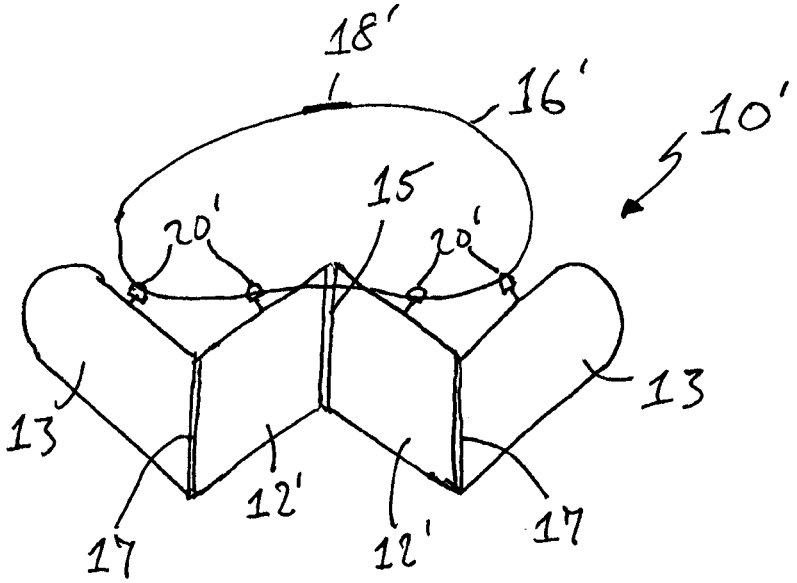
FIG. 6 is an exploded, top perspective view of the duffle bag shown in FIG. 5.

Referring now to FIGS. 5 and 6, in another aspect of the disclosure, a duffle bag designated generally as 10' includes a pair of sections 12' that may be formed as semi-cylindrical sections. As used herein, elements referenced by differently primed or unprimed reference characters correspond to different embodiments of the same element. Sections 12' are secured together along their longitudinal axes with one or two zippers 14'. With two zippers 14', sections 12' can be separated completely into two equal or unequal sections depending upon how each section is structured. For example, one section 12' can be longer than the other section 12' or may have a different radius, if round, to increase or decrease the overall storage space of the section. It should be understood that sections 12' and/or the combination of sections 12' may take on any regular or irregular shape and remain within the scope of the disclosure and appended claims.

One or both sections 12' include at least one secondary zipper 17 (both sections are shown to have a secondary zipper in FIG. 5) that permits each section 12' to be segmented into sub-compartments that may be quarter sections as shown in FIG. 6. Secondary zippers 17 have start and stop ends in close proximity so the zippers extend almost the entire circumference or distance around the sections 12' but leave a permanent connection between the sub-compartments of which a distal compartment 13 can flex away from a base section of sections 12'. Alternatively, secondary zippers 17 may extend around the entire circumference of sections 12' to permit complete separation of the sub compartments.

Duffle bag 10' includes a set of D-ring assemblies 20' with at least two secured to each section 12' and spaced apart to provide balance and stability when bag 10' is lifted and/or carried. Each D-ring assembly 20' may be fixed directly to section 12' or may have a D-ring 21' secured to a post 23', which, in turn, is secured to an anchor plate 25' with the plate secured to section 12'. D-ring 21' can rotate about post 23' and be spring actuated to pull away from the post without disengagement. A single continuous strap 16' is passed through the plurality of D-ring assemblies 20'. The strap length is set to permit the sections 12' duffle bag 20' to be fully unzipped into the connected segmented compartments without interfering with the full separation and axis to the one or more compartments in sections 12' as shown in FIG. 6. One or more shoulder pads/hand grips 18' formed with slots for receiving and interweaving with strap 16' and permit shoulder pad/hand grip 18' to be positioned at different points along strap 16' to provide customization for differently sized individuals.

Figure 7:
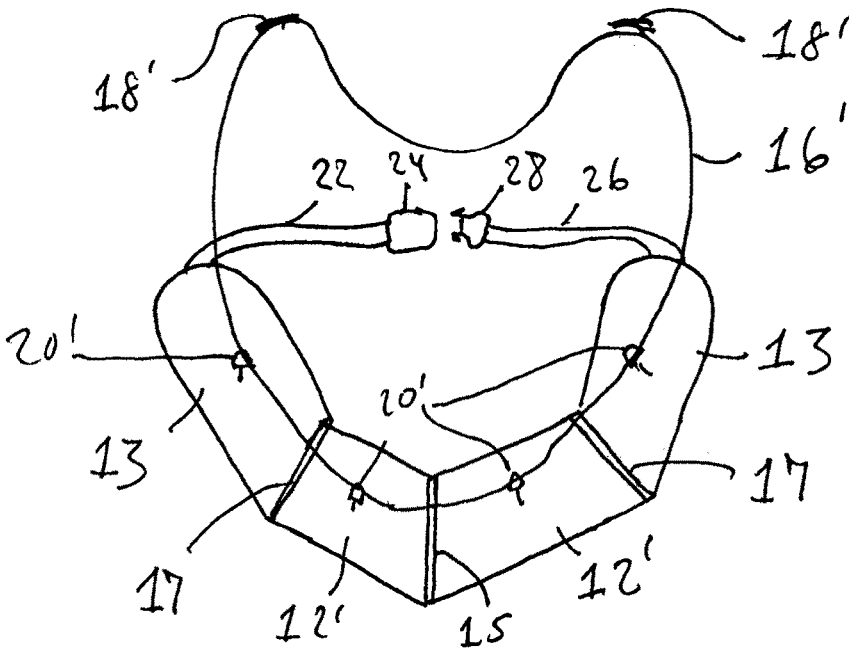
FIG. 7 is a top view of a single-strap, cylindrically-shaped duffle bag with quarter sections and a waist strap according to yet another embodiment of the disclosure.
Figure 8:
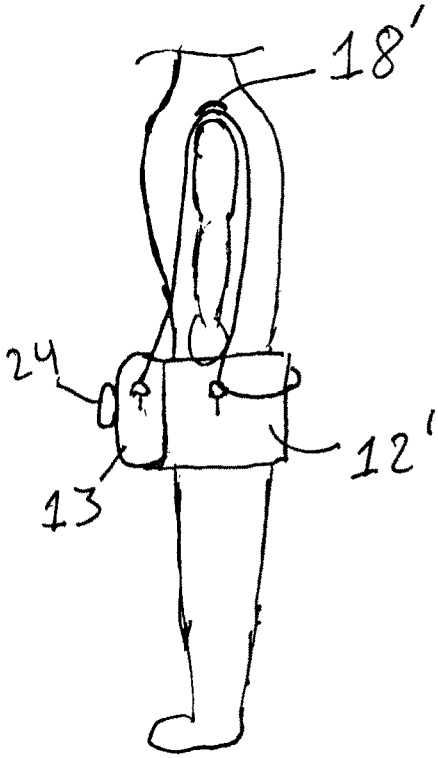
FIG. 8 is a side view of the duffle bag shown in FIG. 7 secured to an individual.

In a further aspect of the disclosure, as shown in FIGS. 7 and 8, the segmented sections of duffle bag 10' can be folded and registered against their outside surfaces to form a u-shaped arrangement. Such an arrangement can be placed around a person's waist. Strap 16' with the two shoulder pad/grips 18' can be arranged to fit over the person's shoulders and function as a harness to suspend duffle bag 10' from the shoulders. An optional belt and buckle assembly as shown in FIG. 7 can be added to the distal segments 13 to provide a means to secure duffle bag 10' around a person's waist.

A first strap 22 is secured to one of the distal segments 13 with a buckle 24 secured to a distal end of strap 22. Buckle 24 includes an aperture dimensioned (not shown) for receiving a latch tongue 28. A second strap 26 is secured to a second of the distal segments 13 with the latch tongue 28 secured to a distal end of second strap 26. To engage latch tongue 28 to buckle 24, the user simply inserts latch tongue 28 into buckle 24 until releasably locking surfaces of tongue 28 and buckle 24 register and engage one another as is conventional in the art and common knowledge. To disengage the buckle/tongue assembly, the release features of the assembly, e.g., depressible locking tines (shown) or release buttons (not shown) are depressed by the user to disengage the registered surfaces of the buckle 24 and the tongue 28. With the belt and shoulder strap combination, a user can carry duffle bag 10' with minimal effort.

Figure 9:
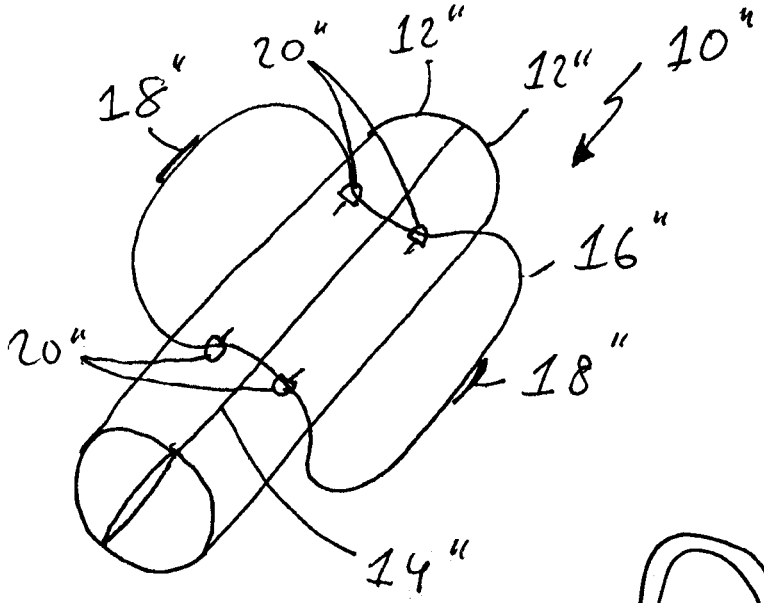
FIG. 9 is a top perspective view of a single-strap, cylindrically-shaped duffle bag according to a further embodiment of the disclosure.
Figure 10:
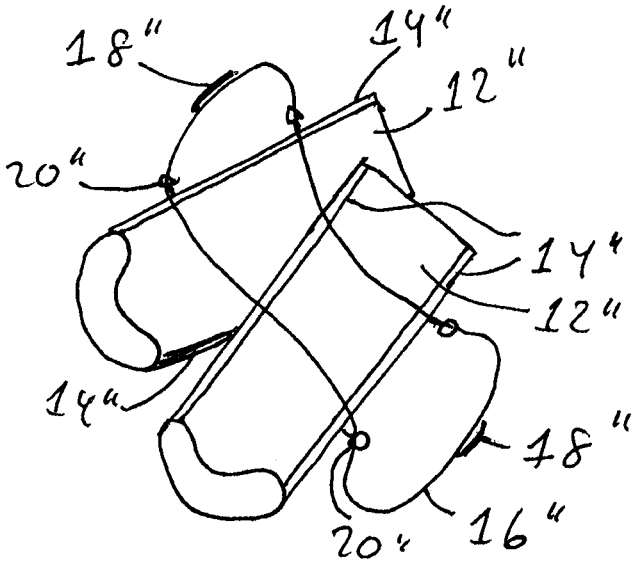
FIG. 10 is a top perspective view of the duffle bag shown in FIG. 9 disassembled.

In a still further aspect of the disclosure as shown in FIGS. 9 and 10, a duffle bag shown designated generally as 10" includes two semi-cylindrical sections 12" secured together with zippers 14" placed along the longitudinal edges of sections 12". Alternatively, sections 12" may be releasably secured together with Velcro® or Velcro-like hook and loop releasable connections. Each section 12" can have single compartment or may include multiple compartments separated illustratively by dividers, pockets, solid flexible walls and mesh walls. Individual closure means such as additional zippers, snap buttons and Velcro® hook and loop releasable connections may be used to further separate multiple compartments. The materials used to construct the duffle bag may be mylar, nylon, and like materials.

Secured to each section 12" are at least two D-ring assemblies 20". Each D-ring assembly 20" may be fixed directly to section 12" or may include a D-ring 21" secured to a post 23", which, in turn, is secured to an anchor plate 25" with the plate secured to section 12". D-ring 21" can rotate about post 23" and be spring actuated to pull away from the post without disengagement. A single continuous strap 16" is passed through the plurality of D-ring assemblies 20". The strap length is set to permit the sections 12" of duffle bag 10" to be fully disassembled without interfering with the full separation and axis to the one or more compartments in sections 12" as shown in FIG. 10. One or more shoulder pads/hand grips 18" formed with slots for receiving and interweaving with strap 16" and permit shoulder pad/hand grip 18" to be positioned at different points along strap 16" to provide customization for differently sized individuals.

As shown in FIG. 10, unlike duffle bag 10, a back end of duffle bag 10" does not include a section connection zipper 15 to releasably secure sections 12" together at a single end. The absence of a zipper 15 permits the sections 12" to be fully disconnected but maintained in close proximity with the strap 16".

The materials used to construct the duffle bags and components such as the straps may be the same for all these components. The components may be injection molded with any thermal plastic materials, including, but not limited to, Polypropylene (PP), Polyethylene (PE), Nylon, and mixtures thereof. The components may be stitched or adhered to together with adhesives as is well known in the art. The buckle/tongue assembly and the D-rings may be made from metals or plastics. It should be understood other materials and manufacturing methods well known in the art also may be used to construct the duffle bags and appended components.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A duffle bag comprising:

a pair of semi-cylindrically-shaped separable compartment segments that combine to form the bag, wherein each compartment segment has two longitudinal edges that define a planar surface of the segment, wherein each compartment segment has an end, and wherein each compartment segment is further partially segmented along a semi-annular line oriented orthogonal to a longitudinal axis of the compartment segment to form a proximal segment and a distal segment;

a pair of longitudinal connection means secured to each segment longitudinal edge to secure the pair of compartment segments together, wherein the longitudinal connection means are selected from the group consisting of zippers, hook and loop fastening systems and combinations thereof, wherein the pair of longitudinal connections means permit the pair of compartment segments to be releasably secured together;

an annular connection means secured along the semi-annular line to secure the proximal and distal segments together, wherein the annular connection means are selected from the group consisting of zippers, hook and loop fastening systems and combinations thereof, wherein the annular connection means permits the proximal segment and the distal segment to be releasably secured together;

a compartment segment end connection means for securing one end of each segment compartment to the end of the other compartment segment and permit the segments to rotate about end connection means, wherein the end connection means is selected from the group consisting of zippers, hook and loop fastener systems, flexible cloth, flexible plastic and combinations thereof;

a plurality of strap-holding rings secured to each of the pair of compartment segments and each of the proximal segments and the distal segments; and, a single continuous strap secured through each of the plurality of holding rings, wherein the strap permits the pair of compartment segments to be partially separated for access to compartments formed in the segments while maintaining a connection between the pair of compartment segments with the strap, and wherein the strap permits the proximal segments and the distal segments to be partially separated apart.

2. The duffle bag of claim 1 wherein at least one of the pair of semi-cylindrical segments is a multi-compartmented segment.

3. The duffle bag of claim 1 wherein at least two of the plurality of strap-holding rings are secured to each of the pair of compartment segments.

4. The duffle bag of claim 1 further comprising at least one shoulder pad/hand grip secured to the strap.

5. The duffle bag of claim 4 wherein the at least one shoulder pad/hand grip has slots for receiving the strap, wherein the shoulder pad/hand grip can freely slide along the length of the strap.

6. The duffle bag of claim 1 wherein the plurality of strap-holding rings are D-rings.

7. The duffle bag of claim 6 wherein at least one of the D-rings are secured to a post secured to one of the pair of compartment segments, wherein the at least one D-ring freely rotates about the post.

8. The duffle bag of claim 1 further comprising a compartment segment end connection means for securing one end of each segment compartment to the end of the other compartment segment, wherein the end connection means is selected from the group consisting of zippers, hook and loop fastener systems, flexible cloth, flexible plastic and combinations thereof.

9. The duffle bag of claim 1 further comprising:

a first belt segment secured to one of the distal segments of one of the pair of compartment segments;

a second belt segment secured to the second of the distal segments of the second of the pair of the compartment segments;

a buckle secured to a distal end of the first belt segment;

a latch tongue secured to a distal end of the second belt segment, wherein the buckle has a tongue-receiving aperture dimensioned to receive the latch tongue, and wherein the latch tongue has releasably-locking surfaces that engage corresponding surfaces in the buckle tongue-receiving aperture.

10. The duffle bag of claim 9 wherein the latch tongue further comprises depressible locking tines that engage the buckle and permit the latch tongue to be disengaged from the buckle.

11. The duffle bag of claim 9 wherein the buckle further comprises a release button for disengaging the latch tongue from the buckle.

* * * * *